United States Patent [19]

Garolis

[11] 4,322,989

[45] Apr. 6, 1982

[54] POWER-OPERATED GEAR-DRIVEN BOX WRENCH

[76] Inventor: Joseph J. Garolis, 1114 73rd St., North Bergen, N.J. 07047

[21] Appl. No.: 75,960

[22] Filed: Sep. 17, 1979

Related U.S. Application Data

[63] Continuation-in-part of Ser. No. 864,838, Dec. 27, 1977, abandoned.

[51] Int. Cl.[3] ..... B25B 17/00

[52] U.S. Cl. ..... 81/57.13; 81/57.29

[58] Field of Search ..... 81/57.13, 57.29, 57, 81/57.11, 57.12, 57.14, 57.28, 57.3, 57.31

[56] References Cited

U.S. PATENT DOCUMENTS

| | | | |
|---|---|---|---|
| 1,346,716 | 7/1920 | Lee | 81/57.29 |
| 2,629,278 | 2/1953 | De Note | 81/57.12 |
| 2,764,048 | 9/1956 | Thompson | 81/57.29 |
| 3,430,510 | 3/1969 | Hendrickson | 81/57.29 |
| 3,987,692 | 10/1976 | Lesner et al. | 81/57.13 |
| 4,171,651 | 10/1979 | Dacunto | 81/57.29 |

FOREIGN PATENT DOCUMENTS

| | | | |
|---|---|---|---|
| 1119464 | 4/1956 | France | 81/57.29 |

*Primary Examiner*—James L. Jones, Jr.
*Attorney, Agent, or Firm*—Burton E. Levin

[57] ABSTRACT

An improved power operated gear-driven box wrench is described in which a tool module containing the work engaging ring gear and both its drive gear and drive shaft can readily be slipped on or off a separate power module containing a motor and drive shaft. Rotational coupling of the tool module drive shaft and that on the power module is accomplished through slideable engageable couplers which are keyed to rotationally lock the drive shafts together. The tool module and the power module also are slideably engaged through coupling collars which are keyed to prevent independent rotation. The ease of changing the tool module permits the operator to select a work engaging gear ring that fits the work without the use of a compensating socket, thus minimizing the work clearance required for use of the wrench.

4 Claims, 3 Drawing Figures

FIG. 1
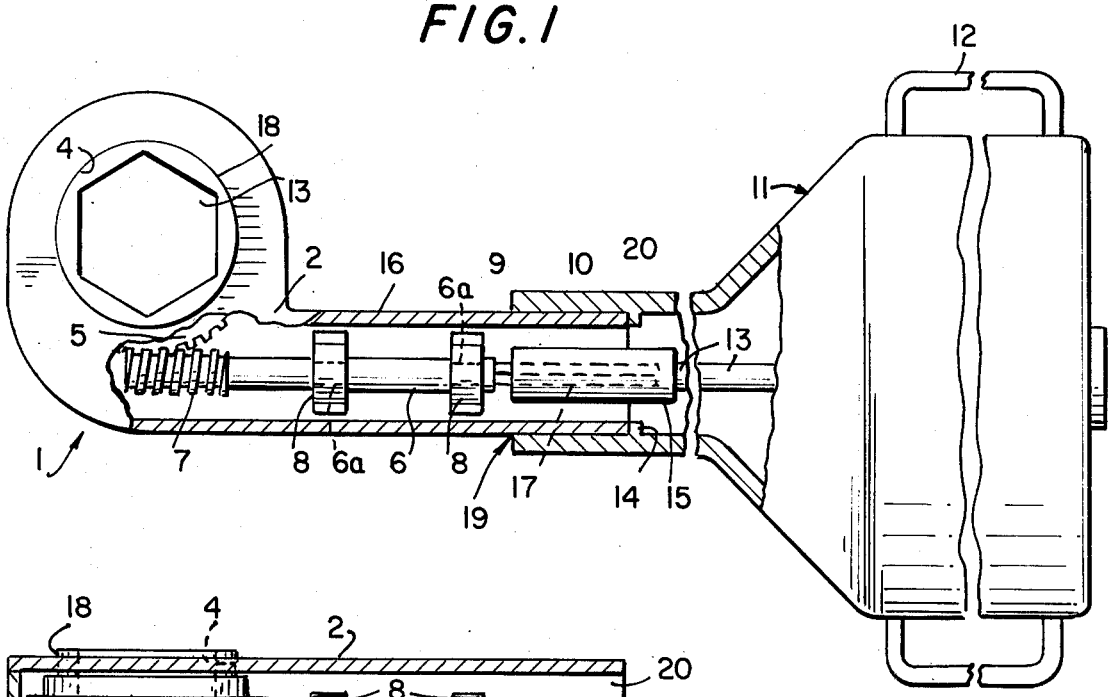
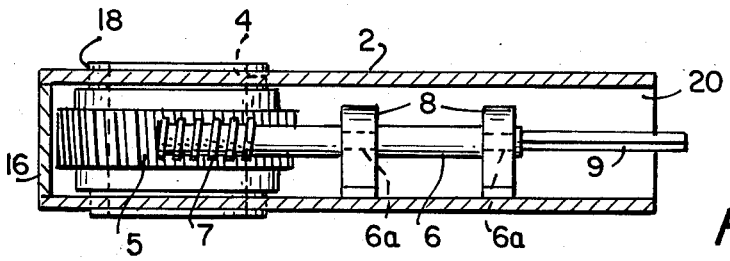
FIG. 2
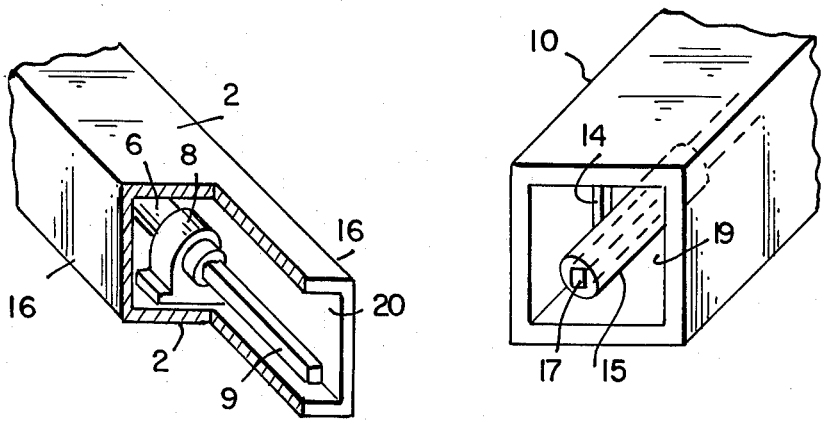
FIG. 3

POWER-OPERATED GEAR-DRIVEN BOX WRENCH

RELATED APPLICATION

This application is a continuation in part of my now abandoned application Ser. No. 864,838, which was filed on Dec. 27, 1977.

BACKGROUND OF THE INVENTION

1. Field of the Invention

This invention relates generally to power-driven wrenches and has for a general object the provision of an improved power wrench that will enable the operator to turn a wide variety of sizes of bolt-heads or nuts when the work clearance is minimal. More particularly, this invention relates to power-driven wrenches in which the work-engaging tool and its housing are easily replaced, thus enabling the operator to select a tool that fits the work piece without the necessity of using a socket, thereby minimizing the work clearance necessary for use of the power wrench.

2. Description of the Prior Art

Both manual and power-operated gear-driven wrenches are well known. Typically, such wrenches comprise a ring gear that is adapted to receive sockets of varying sizes, and a drive shaft which engages the ring gear through a drive gear, all of which are journalled for rotation within a rigid housing. Manually operated wrenches of this type are exemplified by U.S. Pat. Nos. 2,764,048 and 3,630,106. A major disadvantage of such manually operated wrenches is the fact that rotation of the drive shaft applies both a desirable rotational force to the work piece and an undesirable force which is roughly perpendicular to its axis of rotation. In extreme cases, this can lead to damage to threads or even bending of a bolt.

The operator of a power-operated wrench in which the tool housing is integral with or firmly attached to the motor case can compensate for such undesirable force simply by manually applying a force to the motor case counter to the direction of rotation of the motor. Exemplary of such power-operated wrenches are U.S. Pat. Nos. 2,618,187 and 2,693,728. These power-operated wrenches also have a major disadvantage in the inability of a single such wrench to handle work pieces of varying size where the work clearance is small. Whenever a work piece is smaller than the orifice of the ring gear, it is necessary to employ compensating socket inserts in the orifice. When using such socket-fitted power wrench, it is essential that the clearance around small work pieces be greater than that around large ones. Such large clearances often are not available and a variety of complete power wrenches, of varying sizes is necessary.

SUMMARY OF THE INVENTION

It is an object of this invention to provide a power-operated gear-driven box wrench in which the operator easily can change the work-engaging gear ring tool, thus obviating the necessity of using socket inserts and minimizing the work clearance necessary for use of the wrench. A further object of this invention is to provide such power operated wrench in which the tool holder (the work engaging gear ring tool, its drive shaft and drive gear and the housing in which they are journalled) is slideably dismountable from the power source, thus enabling the operator quickly to change tool holders and to employ one that requires minimal work space. A further object of this invention is to provide such wrench in which the tool holder is rotationally locked to the case of the power source, thus enabling the operator manually to apply a force to the case that compensates for the force that otherwise would be applied normally to the axis of rotation of the workpiece.

It has been found that these objects and other advantages, which will be apparent from these specifications, are achieved by the invention described below.

Broadly, my invention is a power-operated gear-driven box wrench comprising an encased source of rotary power engaging one end of a first rotatable drive shaft, the other end of said first shaft bearing a first axial coupling member, a separate tool holder having a rigid housing retaining a rotatable work engaging gear-ring tool and a second rotatable drive shaft, one end of said second shaft engaging said tool through a drive gear and the other end bearing a second axial coupling member, said first and second axial coupling members being slideably engageable and keyed to rotationally lock said drive shafts together, and means to rotationally lock said housing to said power source case.

A more specific embodiment of my invention is such power wrench in which the rotational locking of the tool housing to the power source case is achieved by the use of slideably engageable rigid collars which are keyed for rotationally locking, the first such collar being firmly attached to the power source case and encircling the first axial coupling member and the second such collar being firmly attached to the tool housing and encircling the second axial coupling member. Additional specific embodiments of my invention include such wrenches in which one of the axial coupling members and one of the coupling collars are sockets and the other axial coupling member and the other coupling collar are mating plugs; and such wrenches in which the axial coupling member on the tool holder protrudes from its encircling collar a sufficient distance that its coupling with the other axial coupling member can be accomplished and observed before the collars are coupled.

BRIEF DESCRIPTION OF THE DRAWINGS

FIG. 1 is a plan section of the power wrench of this invention which has been partially cut away to show the slideable engagement of the axial drive shaft coupling members and the coupling collars on the motor case and tool holder.

FIG. 2 is a schematic bottom view, in section, of the tool holder of FIG. 1

FIG. 3 is a partial exploded view of the wrench of FIG. 1, illustrating the relationship of the coupling collars and axial coupling elements.

DESCRIPTION OF THE PREFERRED EMBODIMENTS

The power source usable in this invention can be any encased means of delivering rotary power to the power drive shaft. Electric or compressed air motors are preferred, especially when they include means for reversing rotary power or disengaging same at a predetermined torque.

The tool holder of this invention contains all of the elements of the prior art manually operated gear driven wrenches; i.e. a work engaging gear ring tool, a drive gear and a drive shaft, all of which are journalled for rotation within a rigid housing. Any of the wide variety of known arrangements of such elements may be used. The tool holders of this invention differ, however, from those of the prior art in that the free end of the tool holder drive shaft bears an axial coupling member which is slideably engageable with an axial coupling member on the free end of the power drive shaft. Any means of rotationally locking these axial coupling members and the shafts to which they are attached may be used. For ease of coupling and uncoupling, however, it is preferred than one axial coupling member be a socket having an opening with irregular radial dimensions and that the other axial coupling member be a mating plug. A square opening has been found to be particularly suitable.

Although any means may be used to prevent independent rotation of a power source case and the tool housing, it is preferred, for ease and speed of changing tool holders, to use a slideable engageable coupling. An outstanding type of such coupling comprises rigid collars attached to both the motor case and the tool housing which are slideably engageable and keyed to prevent independent rotation of the collars. Advantageously, each of these collars encircles an axial coupling member and is aligned therewith so that coupling of the axial coupling members and collars can be accomplished in a single motion. It is preferred that the coupling collar attached to the motor case be somewhat larger than that attached to the tool housing so that the former functions as a socket into which the latter is plugged. To prevent independent rotation of the collars, the socket collar advantageously has an opening with irregular radial dimensions and the other collar is a matching plug. The use of an opening having straight equal lengths sides, such as a square, often is desirable, as it permits the tool holder to be coupled in a position relative to the motor case which is most convenient for addressing the work.

Friction between the axial coupling members and the coupling collars usually is sufficient to maintain that coupled position, but it sometimes is desirable to augment this with more positive means of limiting axial movement, such as a spring loaded pin which extends through the wall of the motor module collar and rests in a depression on the outside surface of the tool holder collar.

Since the ability to visually observe coupling of the axial coupling members is desirable, it is preferred that at least one of the axial coupling members extend beyond its encircling collar for a sufficient distance so that the drive shaft coupling can be accomplished before the coupling collars are brought together. It is most preferable that the axial coupling member on the tool holder protrude beyond its collar and that both that axial coupling member and that collar be plugs that mate with corresponding axial coupling member and coupling collar sockets on the motor case.

Referring again to FIG. 1, there is shown a preferred embodiment of this invention in which the tool holder can readily be slipped in and out of the motor case. The case 11 for an electric motor or other power (not shown) bears optional handles 12 and is firmly attached to socket coupling collar 10 which has a square opening 19. The motor is attached through drive shaft 13 to axial coupling socket 15, which has a square opening 17 and which is encircled by collar 10.

The tool holder 1 has a gear ring 18 with a work engaging opening 3. Ring 18 extends axially into and rotates within holes 4 in both rigid bearing plates 2, as more clearly shown in FIG. 2. Gear teeth 5 on ring 18 engage and are driven by worm gear 7 on the end of drive shaft 6. Shaft 6 is held to one of plates 2 by bearings 8. The spacing of bearing plates 2 is maintained by rigid strip 16 which connects the long and curved edges of both plates 2 and forms a rigid housing having an opening 20. A square axial coupling plug 9 on shaft 6 protrudes through opening 20 and mates with square opening 17 in axial coupling socket 15. The edges of plates 2 and strip 16 which border opening 20 function as a plug coupling collar which mates with the square opening 19 in socket coupling collar 10 and is stopped by flanges 14.

As seen more clearly in FIG. 3, the tool holder 1 easily can be slipped in and out of motor case 11 and the engagement of the axial coupling members and coupling collars provides positive means for transmitting rotational force from drive shaft 13 to drive shaft 6 and for preventing independent rotation of the tool holder and motor case.

It will of course be understood that various additions and modifications may be made in the embodiments of this invention described above without departing from the spirit and scope of the invention as defined in the claims below.

The embodiments of the invention in which an exclusive property or privilege is claimed are defined as follows:

1. Power-operated gear-driven box wrench comprising an encased source of rotational power engaging one end of a first rotatable drive shaft, the other end of said first shaft bearing a first axial coupling member and being encircled by a first rigid coupling collar attached firmly to said power source case and a separate tool holder having a rigid housing retaining a rotatable work engaging gear ring tool and a second rotatable drive shaft, one end of said second shaft engaging said tool through a drive gear and the other end bearing a second axial coupling member and being encircled by a rigid second coupling collar attached firmly to said housing, said first and second axial coupling members being slideably engageable, said first and second coupling collars being slideably engageable, one said axial coupling member and one said coupling collar being sockets having openings with irregular radial dimensions and the other said axial coupling member and the other said coupling collar being mating plugs.

2. Wrench of claim 1 wherein said axial coupling plug protrudes from its encircling coupling collar and is slideable deeper into said axial coupling socket than said collar plug is slideable into said collar socket.

3. Wrench of claim 1 wherein each said opening is square.

4. Wrench of claim 1 wherein said first axial coupling member and said first coupling collar each is a socket with an opening having irregular radial dimensions, said second axial coupling member and said second coupling collar each is a mating plug and said second axial coupling member protrudes from said second coupling collar and can be engaged with said first coupling member before said collars are engaged.

* * * * *